US006814768B2

(12) United States Patent
Keller

(10) Patent No.: US 6,814,768 B2
(45) Date of Patent: Nov. 9, 2004

(54) OIL SEPARATOR

(75) Inventor: Erhard Keller, Werneck (DE)

(73) Assignee: SenerTec Kraft-Wärme-Energiesysteme GmbH, Schweinfurt (DE)

( * ) Notice: Subject to any disclaimer, the term of this patent is extended or adjusted under 35 U.S.C. 154(b) by 43 days.

(21) Appl. No.: 10/239,281

(22) PCT Filed: Jan. 18, 2002

(86) PCT No.: PCT/DE02/00149

§ 371 (c)(1),
(2), (4) Date: Sep. 20, 2002

(87) PCT Pub. No.: WO02/059466

PCT Pub. Date: Aug. 1, 2002

(65) Prior Publication Data

US 2003/0136264 A1 Jul. 24, 2003

(30) Foreign Application Priority Data

Jan. 23, 2001 (DE) ..... 101 02 809

(51) Int. Cl.[7] ..... B01D 46/10

(52) U.S. Cl. ..... 55/304; 55/385.3; 55/385.4; 55/400; 55/495; 55/502; 55/527; 55/DIG. 19

(58) Field of Search ..... 55/301, 304, 317, 55/385.1, 385.3, 385.4, 400, 401, 490, 495, 502, 527, 528, 529, DIG. 17, DIG. 25, DIG. 30, DIG. 19; 95/277, 282; 384/473

(56) References Cited

U.S. PATENT DOCUMENTS

| | | | | | |
|---|---|---|---|---|---|
| 3,708,957 | A | | 1/1973 | Labadie | |
| 4,049,401 | A | | 9/1977 | Smith | |
| 4,189,310 | A | * | 2/1980 | Hotta | 55/400 |
| 4,714,139 | A | | 12/1987 | Lorenz et al. | |
| 4,755,103 | A | * | 7/1988 | Streifinger | 384/473 |
| 4,908,050 | A | * | 3/1990 | Nagashima et al. | 55/400 |
| 5,713,972 | A | * | 2/1998 | Snyder, Sr. | 55/385.3 |
| 5,863,317 | A | * | 1/1999 | Smith et al. | 55/502 |
| 6,036,750 | A | * | 3/2000 | Cox | 95/277 |
| 6,139,595 | A | * | 10/2000 | Herman et al. | 55/400 |

FOREIGN PATENT DOCUMENTS

| | | |
|---|---|---|
| DE | 43 30 912 | 3/1995 |
| DE | 196 37 431 | 3/1998 |
| EP | 0 987 053 | 3/2000 |

* cited by examiner

*Primary Examiner*—Duane Smith
*Assistant Examiner*—Jason M. Greene
(74) *Attorney, Agent, or Firm*—Collard & Roe, P.C.

(57) ABSTRACT

An oil separator for use in the crankcase of an internal combustion engine. A rotatable shaft is located in the crankcase and a case lead-in is sealably fixed to the crankcase and concentric to the shaft. A flat filter disk has one face which abuts the case lead-in and an opposite face which is directly secured to the shaft, so that the filter disk rotates with the shaft. Crankcase gasses flow through the filter disk and the filtered gas flows out an opening defined by the case lead-in. The case lead-in may have a flange secured to a connecting piece which passes through a crankcase wall. A draining edge on the outer surface of the case-lead-in prevents oil from contacting the filter when the shaft is at rest.

6 Claims, 1 Drawing Sheet

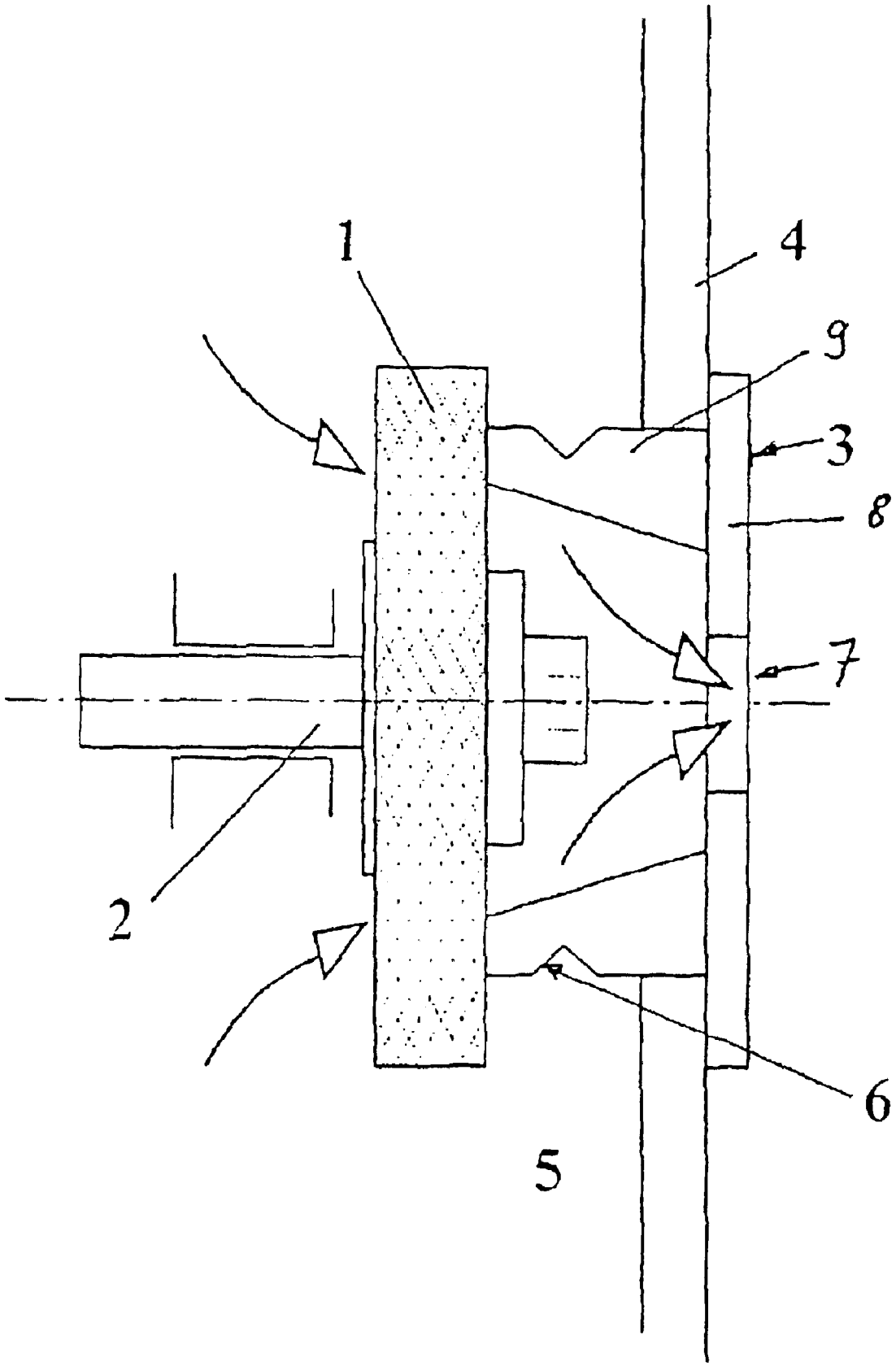
1
4
9
3
8
7
2
6
5

OIL SEPARATOR

CROSS REFERENCE TO RELATED APPLICATIONS

Applicant claims priority under 35 U.S.C. §119 of German Application No. 101 02 809.1 filed Jan. 23, 2001. Applicant also claims priority under 35 U.S.C. §365 of PCT/DE02/00149 filed Jan. 18, 2002. The international application under PCT article 21(2) was not published in English.

BACKGROUND OF THE INVENTION

1. Field of the Invention

The invention relates to a rotatory-working oil separator that purifies the crankcase breather gases of an internal combustion engine.

2. Prior Art

Oil droplets and oil aerosols are a part of the blow-by gases from the crankcase breather of all internal combustion engines. When introducing these gases that contain oil into the suction area of the motor, fouling occurs in the subsequent components, which has a negative effect on the functioning of the motor components. The oil that was carried along must therefore be removed from the crankcase breather gas.

Usually, the oil separation from the crankcase gases occurs with the help of separators that consist of a texture of fibers or with the help of ray deflections on deflecting plates or a combination of these processes. In addition, superfine filters are used, which however work with a high differential pressure.

Cyclone separators need a relatively large installation space and, conditional upon principle, only work optimally in an operating point Electrostatic filters require an additional electrical input and are relatively cost intensive. Moreover, these filters can not be used with combustible gases. Rotatory-working oil separators, in which the oil droplets are spun out with the help of impellers, are also known. They are mostly run with electric motors, air pressure turbines or oil pressure turbines.

The optimal design of the oil separator usually used causes considerable problems because the degree of oil separation and the differential pressure that appears depend on the oil content, the oil temperature, the droplet size distribution, the blow-by flow of gas, the pulsating current, the engine revolutions and the engine stress, and from the sudden revolution and stress changes etc. Therefore, plenum chambers and preliminary filter are still inserted in front of the actual oil separators. These require additional room and cause additional costs. Further cost results still from the oil container, the return valve and the oil return line to the engine's oil sump.

A fume separator mechanism is known from DE 43 30 912 A1, by which a body of rotation is furnished with a filter filling. Fume-forming particles should be hydroextracted by the body of rotation through the effect of centrifugal force in the radial direction. This fume separator mechanism requires however a reservoir and deflecting ribs for the fume-forming particles and is thus not suitable for the purification of blow-by gases. Furthermore, the body of rotation is arranged together with the driving motor inside the housing. This leads to the large dimensions of the fume separator mechanism.

A purifying apparatus is known from DE 196 37 431 A1, by which an air current with particulate solids is guided through a rotating perforated disk. The particulate solids should be seized by the perforated disk and radially spun outward. This purifying apparatus is however not suitable for the separation of liquid materials such as oil droplets or oil aerosols from the air.

SUMMARY OF THE INVENTION

The invention is based on the task of creating an oil separator that can guarantee a nearly complete oil separation from the crankcase breather gases under all operating conditions that can occur and at low differential pressure, and in doing so can be produced at low cost.

This task is accomplished with an oil separator as described herein.

Through this, a filter disk is fastened to a shaft in the crankcase in such a way that the crankcase gases must pass through the filter disk. The oil and soot particles separated on the surface and on the way through the filter disk are spun off through the rotating disk and remain in the crankcase so that no oil collection area and no special oil return is necessary. The self-purifying ability of the rotating filter disk is so great that the differential pressure of the filter also does not substantially change during long running times.

Further features and advantages relating to the invention are described in the specification and drawing.

Oil separators for use in crankcase breathers of an internal combustion engine, which has a filter disk for the flow of gases to be purified, are especially cost-efficient if the filter disk according to an embodiment of the invention is fitted to a camshaft, a differential shaft or a crankshaft of an internal combustion engine. Through this, an oil separator according to an embodiment of the invention does not require any expensive power unit since at least one of the shafts mentioned is present in internal combustion engines anyway.

An especially advantageous use of a rotary filter disk for the flow of gases to be purified is the separation of oil droplets and oil aerosols from gases of a crankcase breather of an internal combustion engine. Such a filter disk can withstand the changing load conditions of the internal combustion engine and can clean itself for a long time. Thus the separation of oil droplets and oil aerosols from the gases of the crankcase breather is nearly maintenance-free. Soot particles are also spun off by the filter disk.

DETAILED DESCRIPTION OF THE INVENTION

The invention allows for numerous embodiments. One of these is illustrated for further clarification of its basic principle in the drawing and is described as follows. This shows in a single FIGURE a filter disk 1, which is fitted to a shaft 2 in the crankcase space of a internal combustion engine that is not diagramed in any more detail. The flow direction of the crankcase breather gases is shown by arrows. The crankcase lead-through 3 is sealed into the crankcase wall 4 and touches the filter disk 1 with its end face. The case lead-in 3 is furnished with a dripping edge 6, so that the oil dripping at the crankcase wall 4 when the engine is shutdown will not reach the filter disk 1.

Case lead-in 3 may comprise a flange 8 and an adjacent connecting piece 9 wherein connecting piece 9 passes through a crankcase wall 4. As shown by the arrows in the drawing, once the gases to be filtered from crankcase space 5 pass through filter disk 1, the filtered or purified gases flow out of the crankcase via opening 7. Inner walls of case lead-in 3 may be funnel-shaped and tapered towards opening 7.

What is claimed is:

1. An oil separator for use in a crankcase of an internal combustion engine, the oil separator comprising:

(a) a rotatable shaft disposed in the crankcase;

(b) a case lead-in concentric to said rotatable shaft and sealably fixed to the crankcase, said case lead-in defining an opening in the crankcase through which a filtered gas flows;

(c) a flat filter disk having one face abutting said case lead-in and having an opposite face directly secured to said rotatable shaft such that said flat filter disk rotates with said rotatable shaft, wherein a gas to be filtered flows through said flat filter disk and out said opening.

2. An oil separator for use in a crankcase of an internal combustion engine, the oil separator comprising:

(a) a rotatable shaft disposed in the crankcase;

(b) a case lead-in concentric to said rotatable shaft and sealably fixed to the crankcase, wherein said case lead-in defines an opening in the crankcase through which a filtered gas flows, said case lead-in comprising:

(i) a flange; and (ii) an adjacent connecting piece secured to said flange and passing through a wall of the crankcase; and (c) a flat filter disk having one face abutting said adjacent connecting piece of said case lead-in and having an opposite face directly secured to said rotatable shaft such that said flat filter disk rotates with said rotatable shaft, wherein a gas to be filtered flows through said flat filter disk and out said opening.

3. An oil separator for use in a crankcase of an internal combustion engine, the oil separator comprising:

(a) a rotatable shaft disposed in the crankcase;

(b) a case lead-in concentric to said rotatable shaft and sealably fixed to the crankcase, wherein said case lead-in defines an opening in the crankcase through which a filtered gas flows, said case lead-in comprising:

(i) a flange;

(ii) an adjacent connecting piece secured to said flange and passing through a wall of the crankcase; and (iii) a draining edge disposed on an outer surface of said adjacent connecting piece within the crankcase; and (c) a flat filter disk having one face abutting said adjacent connecting piece of said case lead-in and having an opposite face directly secured to said rotatable shaft such that said flat filter disk rotates with said rotatable shaft, wherein a gas to be filtered flows through said flat filter disk and out said opening and wherein said draining edge prevents oil from contacting said filter disk when said shaft is not rotating.

4. The oil separator of claim 1 wherein said filter disk comprises a fibrous material.

5. The oil separator of claim 1 wherein an inner wall of said case lead-in is funnel-shaped and is tapered toward said opening.

6. The oil separator of claim 1 wherein said rotatable shaft is selected form the group consisting of a camshaft, a differential shaft and a crankshaft.

* * * * *